United States Patent [19]

Lantto

[11] 4,107,812

[45] Aug. 22, 1978

[54] SQUEEGEE WITH MOISTURE REMOVING MEANS

[76] Inventor: Joseph R. Lantto, 702 Fourth Ave. NW., Buffalo, Minn. 55313

[21] Appl. No.: 703,692

[22] Filed: Jul. 8, 1976

[51] Int. Cl.[2] ..... A47L 1/08

[52] U.S. Cl. ..... 15/245; 15/121; 15/144 B; 15/250.36

[58] Field of Search ..... 15/117, 121, 244 R, 15/245, 250.36, 143 B, 144 B; 401/23–27

[56] References Cited

U.S. PATENT DOCUMENTS

| | | | |
|---|---|---|---|
| 2,727,271 | 12/1955 | Oishei et al. | 15/250.42 |
| 3,051,975 | 9/1962 | Schwartz | 15/117 X |
| 3,090,985 | 5/1963 | Baum | 15/244 R |
| 3,649,987 | 3/1972 | Tomingas et al. | 15/245 |
| 3,769,651 | 11/1973 | Sunskes | 15/121 |
| 3,837,747 | 9/1974 | Seymore | 15/121 X |
| 3,919,736 | 11/1975 | Bourassa | 15/250.42 |
| 3,961,392 | 6/1976 | Young | 15/210 R X |
| 3,968,535 | 7/1976 | Nichols | 15/121 |

FOREIGN PATENT DOCUMENTS

| | | | |
|---|---|---|---|
| 42,869 | 8/1970 | Finland | 15/245 |
| 817,467 | 10/1951 | Fed. Rep. of Germany | 15/245 |
| 75,481 | 8/1949 | Norway | 15/144 B |
| 352,473 | 4/1961 | Switzerland | 401/23 |
| 909,288 | 10/1962 | United Kingdom | 15/121 |

*Primary Examiner*—Daniel Blum
*Attorney, Agent, or Firm*—Peter Kent

[57] ABSTRACT

A squeegee has a handle, and includes an elongated blade holder disposed transverse thereto; the blade holder is formed with an elongated recess of T-shaped cross-section into which an elongated blade, having a matching T-shaped projection, fits, so that the blade is easily interchanged with another blade. A second and smaller handle formed with a blade gripper is slidably attached to the blade so as to remove moisture therefrom when sliding along the length thereof.

2 Claims, 6 Drawing Figures

SQUEEGEE WITH MOISTURE REMOVING MEANS

BACKGROUND OF THE INVENTION

1. Field of the Invention

The field of the present invention relates to a windshield squeegee having moisture removing means.

2. Description of the Prior Art

A squeegee mop is known which is provided with a liquid absorbent applicator in order to provide a combination washing and wiping device for use in the cleaning of vertical surfaces; there is also known a combined washer and squeegee for cleaning the windows of a house, automobile or the like in which the rubber squeegee blade is reinforced with a rigid backing member throughout the greater portion of its length and width. There is also known a window swab, a device for cleaning windows, a snow and ice removal tool, a telescoping implement handle, a squeegee having a handle adapted for detachable connection to a brush and a feather duster with an extensible handle.

SUMMARY OF THE INVENTION

It is accordingly, an object of my present invention to devise a squeegee which upon becoming wet will be dried very quickly by a novel means.

I accordingly provide a squeegee which includes an elongated handle provided with an elongated blade holder disposed transverse thereto; the blade holder is formed with an elongated recess which has a T-shaped cross-section. An elongated blade formed with an elongated projection on the side opposite the blade, and wherein the projection has a T-shaped cross-section matching the cross-section of the elongated recess, fits slidingly into the latter; the blade is therefore interchangeable with another blade. In a preferred version of my invention, the handle and the holder are unitary and made of synthetic plastic material. The blade holder is additionally formed with a second elongated recess which has also a T-shaped cross-section, the latter cross-section being disposed at a right angle to the first cross-section and includes a second handle formed with a T-shaped projection slidingly fitting into the second elongated recess. The second handle has a blade gripper fitting over the blade, so that upon the second handle being slid along the second recess the blade is wiped free of moisture. The blade is preferably made of rubber or the like, and the blade gripper compresses a portion of the blade so that the remaining portions thereof project beyond the blade gripper, so as not to interfere with wiping action of the squeegee.

BRIEF DESCRIPTION OF THE DRAWING

My invention will be better understood with reference to the accompanying drawing, in which.

DESCRIPTION OF THE PREFERRED EMBODIMENT

Figure 1:
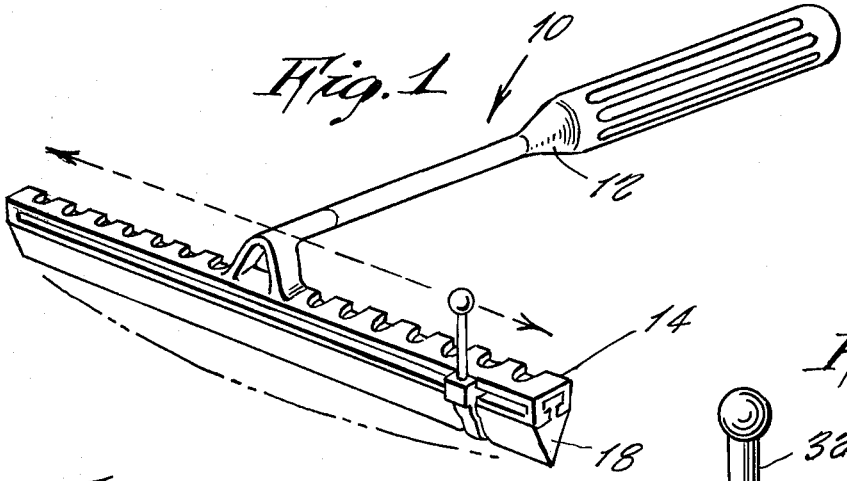
FIG. 1 shows a perspective view of the squeegee, according to my invention.
Figure 2:
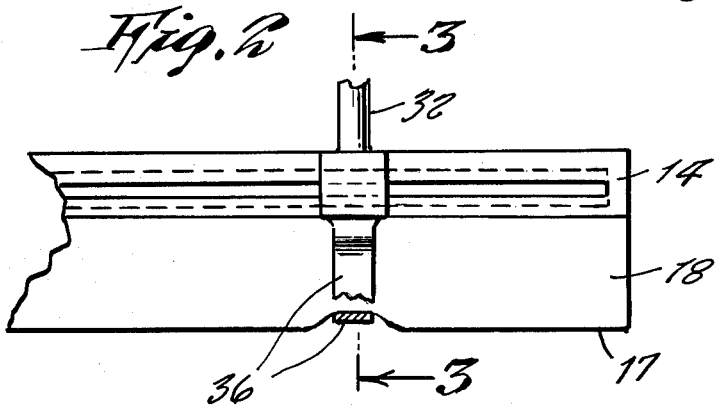
FIG. 2 shows a detail of FIG. 1 in plan view.

Referring now to FIGS. 1 through 4, a squeegee 10 includes an elongated handle 12 which has an elongated bladeholder 14 disposed transverse thereto; the bladeholder 14 is formed with an elongated recess which has a T-shaped cross-section. Blade 18 is provided a corresponding longitudinal T-shaped projection 20 opposite blade edge 17 for slidingly inserting projection 20 into recess 16 thereby affixing blade 18 to blade holder 14. The blade 18 is therefore interchangeable with another blade. In one version of my invention, the handle 12 and the holder 14 are unitary and made of synthetic plastic material.

Figure 5:
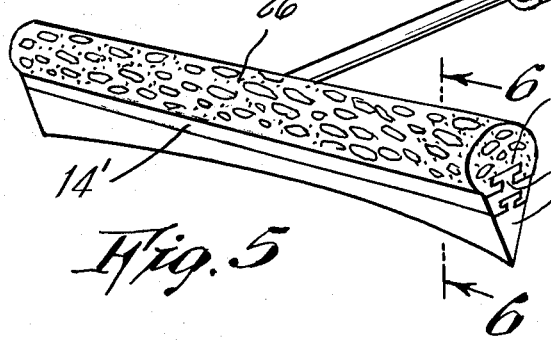
FIG. 5 is an alternate perspective view of a squeegee.
Figure 6:
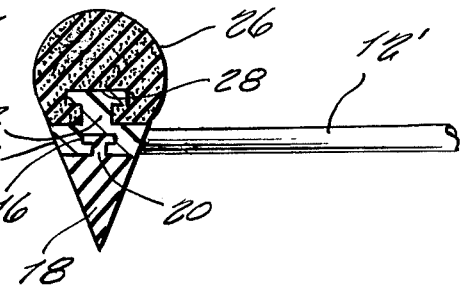
FIG. 6 is a cross-sectional view taken along the line 6—6 of FIG. 5.

In another version shown in FIG. 5, the handle 12' is telescopically extensible and includes means for adjusting and setting the length thereof; these means include a screw 22 which may be threaded into the telescopic handle to set the desired length thereof. The holder 14' is formed with an elongated extension 24, which has a T-shaped cross-section and includes a roll 26 of spongy material having an elongated recess 28 of T-shaped cross-section for the elongated extension 24 of the holder 14' to slidingly fit thereinto.

Figure 3:
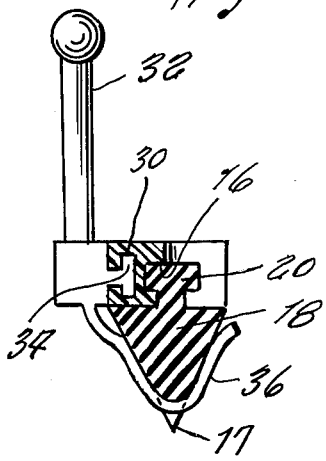
FIG. 3 shows a cross-sectional view of FIG. 2 along the lines 3—3.
Figure 4:
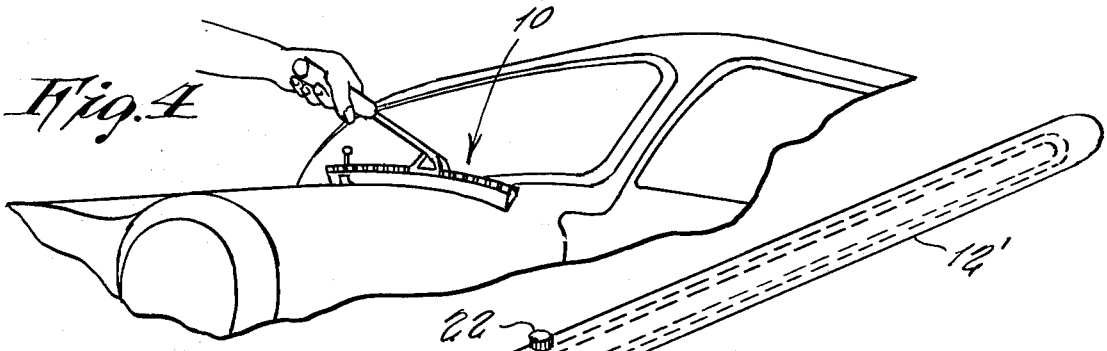
FIG. 4 is a perspective view of the squeegee in action.

FIG. 3 further shows blade holder 14' formed with a second elongated recess 30, which also has a T-shaped cross-section; the latter cross-section is disposed substantially at right angles to the first cross-section, and a second handle 32 is formed with a T-shaped projection 34 slidingly fitting into the second elongated recess 30. The second handle 34 has a blade-gripper 36 which fits over the blade 18, so that upon the second handle 32 being slid along the second recess 30, the blade 18 is squeezed and wiped free of moisture. The blade 18 is preferably made of rubber or the like, and the blade gripper 36 preferably compresses a portion of the blade 18 so that the remaining portions thereof project beyond the blade-gripper 36.

Although the invention has been described with respect to a preferred version thereof, it is to be understood that it is not to be so limited since changes can be made therein which are within the full intended scope of the appended claims.

What is claimed is:

1. A squeegee comprising:

an elongated handle having an elongated blade holder disposed transverse thereto, said blade holder being formed with a first elongated recess having a T-shaped cross-section, an elongated squeegee blade formed with an elongated projection on a side opposite the working edge thereof, said projection having a T-shaped cross-section matching the cross-section of said elongated recess for slidingly fitting into the latter, whereby said blade is interchangeable with another blade, a second elongated recess having a T-shaped cross-section formed in said holder and, disposed at right angles to said first elongated recess, a second handle formed with a T-shaped projection slidingly fitting into said second elongated recess, said second handle having a blade-gripper fitting over said blade, whereby upon said second handle being slid along said second recess said blade is wiped free of moisture.

2. A squeegee mop according to claim 1, wherein said blade is made of rubber or the like, and wherein said blade gripper comprises a portion of said blade so that the remaining portions thereof project beyond said blade-gripper.

* * * * *